US007086555B2

(12) United States Patent
Overholt et al.

(10) Patent No.: US 7,086,555 B2
(45) Date of Patent: Aug. 8, 2006

(54) CONTAINER

(75) Inventors: Trenton M. Overholt, Manhattan Beach, CA (US); Gerald R. Koefelda, Seal Beach, CA (US); Roger S. Hsu, Torrance, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 370 days.

(21) Appl. No.: 10/164,038

(22) Filed: Jun. 3, 2002

(65) Prior Publication Data

US 2002/0148842 A1 Oct. 17, 2002

Related U.S. Application Data

(63) Continuation of application No. 09/667,962, filed on Sep. 21, 2000, now Pat. No. 6,409,041.

(51) Int. Cl.
*B65D 6/08* (2006.01)
*B65D 6/10* (2006.01)
*B65D 92/02* (2006.01)

(52) U.S. Cl. ..... 220/669; 220/6; 220/675

(58) Field of Classification Search ..... 220/669, 220/670, 675, 7, 509, 516, DIG. 15, 6, 1.5; 206/503
See application file for complete search history.

(56) References Cited

U.S. PATENT DOCUMENTS

| | | | | |
|---|---|---|---|---|
| 3,446,415 | A | | 5/1969 | Bromley |
| 3,628,683 | A | | 12/1971 | Friedrich |
| 3,796,342 | A | | 3/1974 | Sanders et al. |
| 3,874,546 | A | | 4/1975 | Sanders et al. |
| B513,789 | I5 | | 2/1976 | Koen |
| 3,973,692 | A | | 8/1976 | Cloyd |
| 4,005,795 | A | | 2/1977 | Mikkelsen et al. |
| 4,044,910 | A | | 8/1977 | Box |
| 4,062,467 | A | | 12/1977 | Friedrich |
| 4,081,099 | A | | 3/1978 | Shead |
| 4,163,495 | A | | 8/1979 | Drader |
| 4,165,003 | A | * | 8/1979 | Drader ..... 206/506 |
| 4,170,313 | A | | 10/1979 | Caves et al. |
| 4,181,236 | A | | 1/1980 | Prodel |
| 4,197,958 | A | * | 4/1980 | Zeni et al. ..... 206/503 X |
| 4,235,345 | A | | 11/1980 | VandeDrink et al. |
| 4,300,695 | A | | 11/1981 | Hsu |
| 4,314,686 | A | | 2/1982 | März |
| 4,347,941 | A | * | 9/1982 | Johanssen et al. ..... 220/6 |
| 4,349,120 | A | | 9/1982 | DiNardo |
| 4,364,477 | A | * | 12/1982 | Stromberg ..... 206/511 |
| 4,663,803 | A | | 5/1987 | Gora |
| 4,674,647 | A | | 6/1987 | Gyenge et al. |
| 4,735,331 | A | | 4/1988 | Keenan et al. |
| 4,741,032 | A | | 4/1988 | Hampton |
| 4,765,480 | A | | 8/1988 | Malmanger |

(Continued)

FOREIGN PATENT DOCUMENTS

DE 27 34 964 A1 2/1979

(Continued)

*Primary Examiner*—Nathan J. Newhouse
*Assistant Examiner*—Harry Grosso

(57) ABSTRACT

A wall structure for a container includes at least one band member which extends at least partially across the length of the wall structure proximate an upper surface of the wall structure and oriented substantially parallel thereto. The band member has a wave-like cross-section with a plurality of first peaks, adjacent and opposing second peaks, and inclined members extending between the plurality of first and second peaks. The plurality of first peaks of the wave defines a first surface of the wall structure, and the opposing second peaks of the wave defines a second surface of the wall structure.

21 Claims, 9 Drawing Sheets

U.S. PATENT DOCUMENTS 4,775,068 A 10/1988 Reiland et al.
4,775,069 A * 10/1988 Stonier et al. ..... 220/6
4,776,457 A 10/1988 Ferraroni
4,781,300 A 11/1988 Long
4,809,874 A 3/1989 Pehr
4,846,089 A 7/1989 Cedergreen
4,887,747 A 12/1989 Ostrowsky et al.
D306,264 S 2/1990 Malmanger
4,923,079 A 5/1990 Foy
4,940,155 A 7/1990 Hewson
4,960,223 A 10/1990 Chiang et al.
4,967,927 A 11/1990 Reiland et al.
4,979,634 A 12/1990 Begley
5,038,953 A 8/1991 Radar
5,048,715 A 9/1991 Wolff
5,076,457 A 12/1991 Marovskis
5,114,037 A 5/1992 Hillis et al.
5,161,709 A 11/1992 Oestreich, Jr.
5,183,180 A 2/1993 Hawkins et al.
5,289,935 A 3/1994 Hillis et al.
5,328,048 A 7/1994 Stein
D349,813 S 8/1994 Schwartzkopf
5,353,948 A 10/1994 Lanoue et al.
5,361,923 A * 11/1994 Knight, IV et al. ..... 220/6
5,398,834 A 3/1995 Umiker
5,429,261 A 7/1995 Machino
5,474,197 A 12/1995 Hillis et al.
5,474,200 A 12/1995 Nicholson
5,515,987 A 5/1996 Jacques et al.
5,564,599 A 10/1996 Barber et al.
5,588,549 A 12/1996 Furtner
5,622,276 A 4/1997 Simmons
5,632,392 A 5/1997 Oh
5,671,857 A 9/1997 Stromberg
5,699,926 A 12/1997 Jacques et al.
5,823,376 A * 10/1998 McGrath ..... 220/516
5,829,617 A 11/1998 Umiker
5,850,936 A 12/1998 Umiker
5,853,099 A 12/1998 Lessard
D413,439 S 9/1999 Bell
5,975,324 A 11/1999 Schmitt
6,015,056 A * 1/2000 Overholt et al. ..... 220/6
6,029,840 A 2/2000 Brauner
D423,217 S 4/2000 Varfeldt
D424,298 S 5/2000 Laib
D424,299 S 5/2000 Varfeldt
6,073,790 A 6/2000 Umiker
6,098,827 A 8/2000 Overholt et al.
6,131,757 A 10/2000 Clark et al.
6,142,329 A 11/2000 Dotan
6,209,742 B1 * 4/2001 Overholt et al. ..... 220/6
6,409,041 B1 * 6/2002 Overholt et al. ..... 220/669

FOREIGN PATENT DOCUMENTS

DE 43 19 099 A1 5/1994
EP 0 127 414 12/1984
EP 0 178211 A1 9/1985
EP 0 404041 A1 12/1990
EP 0 485 672 A1 2/1992
EP 0 962 394 12/1999
EP 0 962 396 12/1999
WO WO 86/01182 2/1986
WO WO 97/15502 5/1997
WO WO 00/01586 1/2000
WO WO 00/63084 A1 10/2000

* cited by examiner

CONTAINER

This is a continuation application Ser. No. 09/667,962 filed on Sep. 21, 2000 now U.S. Pat. No. 6,409,041.

TECHNICAL FIELD

This invention relates to a multi-purpose container adaptable for the storage and transport of produce items and other goods.

BACKGROUND ART

Containers and crates are commonly used to transport and store a variety of items. Such crates are typically formed of injection molded plastic. When in use, such containers are typically rectangular in shape and have a flat base surrounded by four upstanding side panels extending from the base. Sometimes the containers are collapsible, such that when they are not in use, the collapsible feature of the containers allows the containers to be folded or otherwise reduced in size, thereby providing a desired compact size for conserving storage space.

These containers are often formed of various components, including the side panels and the base, which are molded separately. In particular, the walls typically include strengthening ribs on their outer surfaces in order to provide strength and torsional resistance to the parts. However, during the molding process, the components having ribs (such as the longer side panels), may be subject to slight warpage and deformation during cooling, when plastic tends to shrink. The warping may particularly occur at the edges of the parts. In these circumstances, the warping and any resulting scrapped parts may lead to elevated manufacturing and part costs.

When assembled or in use, these containers are often stacked upon each other, with the load of an upper container placed directly on the assembled walls of the container positioned therebelow. While these containers are capable of use for multiple purposes, they are frequently adapted to receive perishable food items, such as produce. Produce such as bananas is often stored and shipped in cooling systems, so that the produce is able to remain fresh as well as continue to ripen during storage and shipment to the market. Many containers, however, are not able to adequately provide the produce with sufficient circulation in this environment.

Consequently, an improved container is desired which, when in the assembled orientation, is capable of supporting the weight and load of containers stacked thereabove. The container and its components should also be resistant to warpage during the molding and cooling process. The container should also allow for improved circulation and air flow for the goods and produce stored and shipped within the container.

DISCLOSURE OF INVENTION

It is an object according to the present invention to provide a container which is capable of supporting the weight and load of containers and other objects stacked thereabove.

It is still another object according to the present invention to provide a container having components which are resistant to warpage during the cooling and/or curing phases of the molding process.

It is yet another object according to the present invention to provide a container having walls with improved ventilation and air flow for the goods stored and shipped within the container.

In keeping with the above objects and goals according to the present invention, provided is wall structure for a container having at least one band member extending at least partially across the length of the wall structure proximate an upper surface of the wall structure and oriented substantially parallel thereto. The band member has a wave-like cross-section having a plurality of first peaks, adjacent and opposing second peaks, and inclined members which extend between the plurality of first and second peaks, wherein the plurality of first peaks of the wave defines a first surface of the wall structure, and opposing second peaks of the wave defines a second surface of the wall structure. In one embodiment, the first peaks have a rounded profile, and in other embodiment have a flat profile. Still further, adjacent first peaks define a first recess therebetween which define the opposing second peak. Likewise, adjacent second peaks define a second recess therebetween which define the first peak. Also, a plurality of band members may be included in the wall structure formation, which are oriented parallel to each other. In one embodiment, the band member is disposed proximate an upper edge of the wall structure.

Further in accordance with the present invention, provided is an integral wall formation for a container, where the wall formation include an inner surface and an outer surface having a continuous, undulating wave-like member which extends between the inner and outer surfaces. The inner peak of the wave-like member is co-planar with the inner surface, and an outer peak of the wave-like member is co-planar with the outer surface.

Yet still further in accordance with the present invention, provided is a wall structure for a container including a wall member which has an upper edge which is adapted to support a load thereupon, and also has proximate to the upper edge an inner surface portion which is defined by a plurality of alternating inwardly-directed peaks and outwardly-directed recesses. These alternating features define a corresponding outer surface having, respectively, a plurality of alternating inwardly-directed recesses and a outwardly-directed peaks.

According to the present invention, further provided is a wall structure for a container including a wall member which has an axial band portion formed therein which includes a pair of substantially planar first and second surfaces and an undulating member which extends between the first and second surfaces. Approximately half of the undulating member is disposed between each of the first and second surfaces and a plane oriented parallel to and mid-way between the first and second surfaces, Another wall formation for a container provided according to the present invention includes an upper edge and a pair of opposing lateral edges. It also includes an inner surface and an outer surface which are disposed proximate the upper edge and have a continuous linear array of alternating peaks and valleys extending between the pair of opposing lateral edges, wherein the peaks have a flat profile.

Still in accordance with the present invention, provide is an upstanding side wall formation for a container, where the formation includes an inner surface, an outer surface, an upper edge, and a lower edge. It also includes at least one band portion parallel to the upper edge and disposed proximate thereto. The band portion has a step wave-like cross-section for providing uniform material distribution between the inner and outer surfaces. Further, the wall formation further includes a plurality of venting apertures proximate the lower edge. In one embodiment, the wall formation further includes a handle aperture disposed below the at least one band portion, such that the handle aperture and venting apertures define approximately six percent of the surface area of the wall. The upstanding wall formation further includes a central wall portion, wherein the at least one band portion may be disposed above the central wall portion, and the plurality of venting apertures may be included in the wall formation below the central wall portion.

Moreover, a side wall formation for a container includes an upper portion, a central portion and a lower portion having a lower edge proximate thereto, wherein the wall formation includes a handling aperture in the upper portion, a plurality of venting apertures in the lower portion, and a solid central portion. Preferably, the handling aperture and the venting apertures comprise approximately six percent of the wall formation surface area.

BEST MODE FOR CARRYING OUT THE INVENTION

Figure 1:
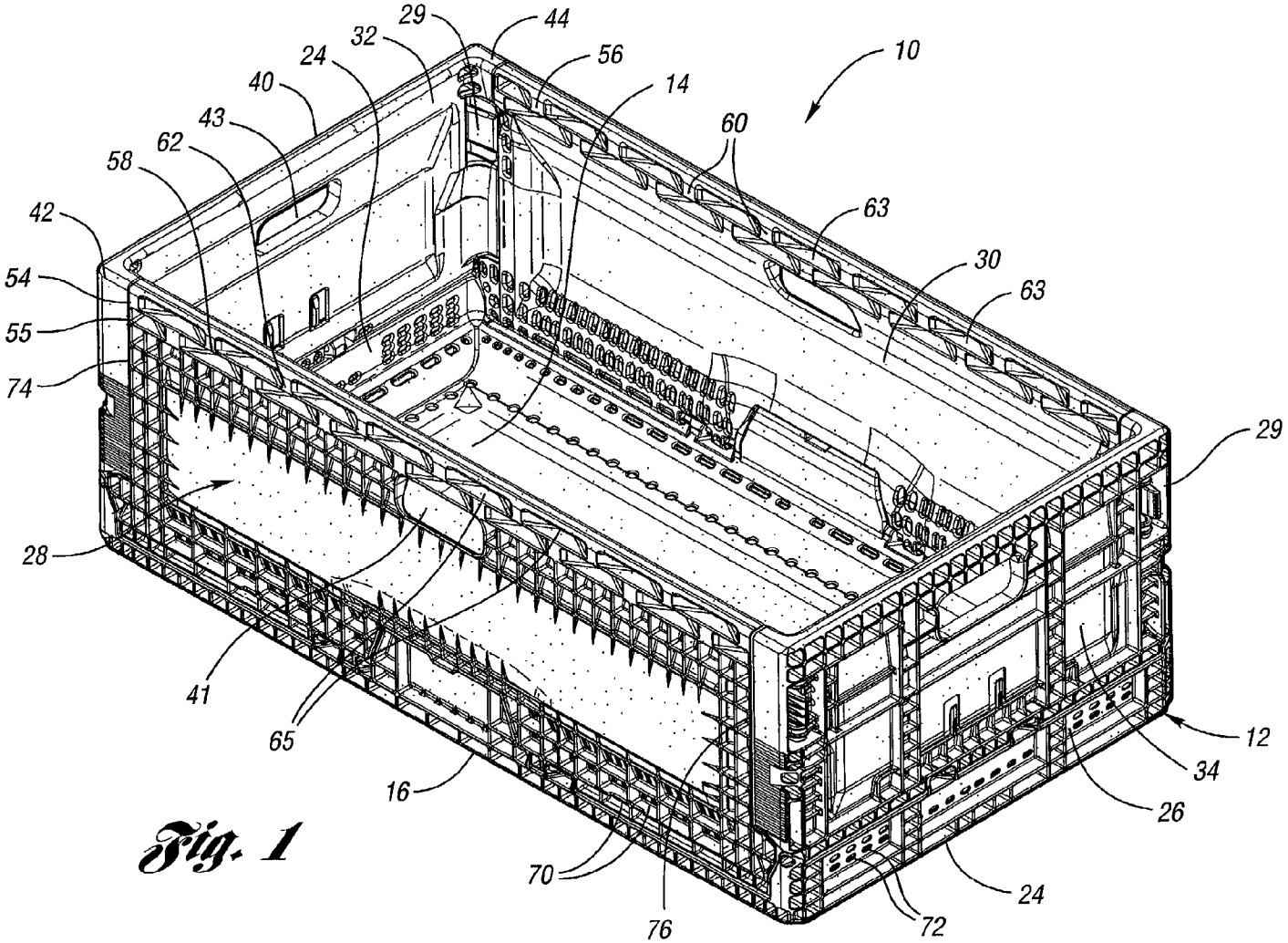
FIG. 1 of the drawings illustrates a perspective view of the container according to the present invention.

With reference to FIG. 1 of the drawings, illustrated therein is a container 10 according to the present invention. Container 10 is also appropriately referred to as a box, crate, or tray. Container 10 is typically formed of thermoplastic resin, such as polypropylene, via an injection molding process or other plastic molding process suitable to this application. While container 10 is suitable for many uses, it is particularly suited for the storage and transport of perishable goods and produce such as fruits and vegetables, and more particularly bananas, where circulation of air and/or refrigerated gas is necessary to develop and maintain the produce freshness and ripening during shipment to the market. As is disclosed further herein, this circulation is fostered through appropriately placed venting apertures provided in container 10.

Container 10 includes a base member 12 having a bottom wall 14 which serves as the lower support for the container. As is best shown in the top plan view of FIG. 8, bottom plan view of FIG. 9, and the exploded partial perspective view of FIG. 3, bottom wall 14 is generally rectangular in shape and has four perimeter edges—namely, a pair of opposed side edges 16 and 18, and a pair of opposed end edges 20 and 22. In this embodiment, base 12 further includes integrally molded upstanding flanges 24 and 26 (or base end walls) oriented substantially perpendicular to bottom wall 14, each defining an upper side edge 25 and 27, respectively. As is well understood in the art, the wall thickness of each of the walls and components illustrated and disclosed herein may vary depending on the intended usage and other characteristics desired from container 10. Moreover, while container 10 is illustrated as having a rectangular shape, it is fully contemplated that the teachings according to the present invention are equally applicable to a square container, or various other container shapes.

As shown in FIGS. 1–4, container 10 also includes a first pair of opposed side walls 28 and 30, which are situated opposite each other across bottom panel 14. In the illustrated embodiment, side walls 28, 30 are each attached to base 12 by way of a hinging configuration or system 19, 21 (best shown in FIG. 3), located at edges (16,18) of bottom panel 14. Thus, side walls (28, 30) fold or pivot relative to base 12 at edges 16, 18. Such separately molded components and hinging system allows side walls 28, 30 to be foldably positioned in three orientations: the assembled container orientation as illustrated in FIG. 1, an outwardly collapsed orientation, and an inwardly collapsed orientation. The hinging system and wall orientations are more particularly disclosed in U.S. Pat. No. 6,015,056, which is incorporated fully herein by reference. Of course, this type of hinge is shown by way of example and not limitation, as the hinging system utilized for this container 10 may be any type known or contemplated which is feasible for this use. While the embodiment illustrated is a collapsible container, it is fully contemplated that the teachings according to the present invention are applicable to various types of containers, both collapsible and non-collapsible.

Figure 3:
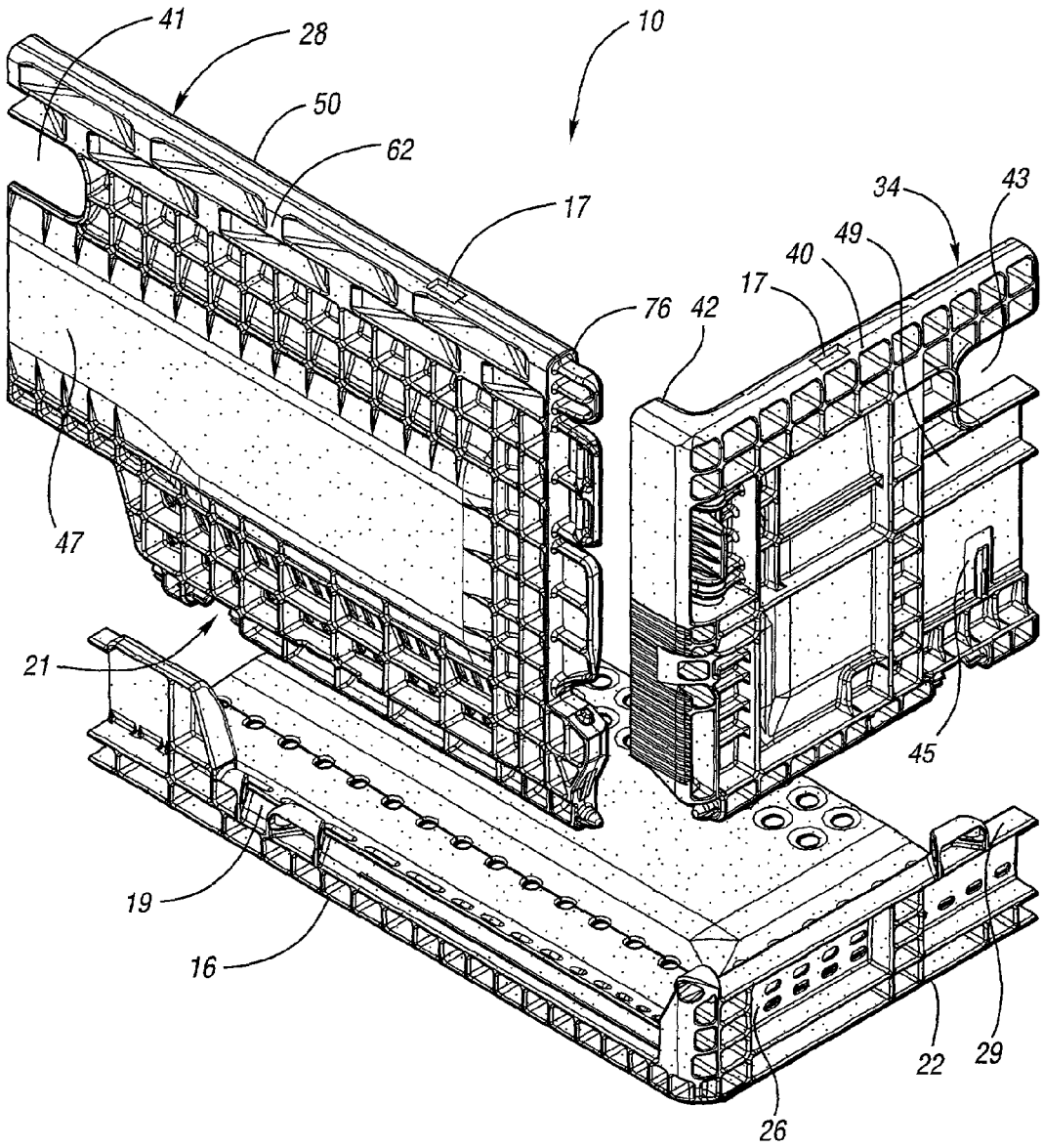
FIG. 3 is a partial perspective view of an exploded assembly view of the side walls, end walls, and base of the container of FIG. 1.
Figure 10:
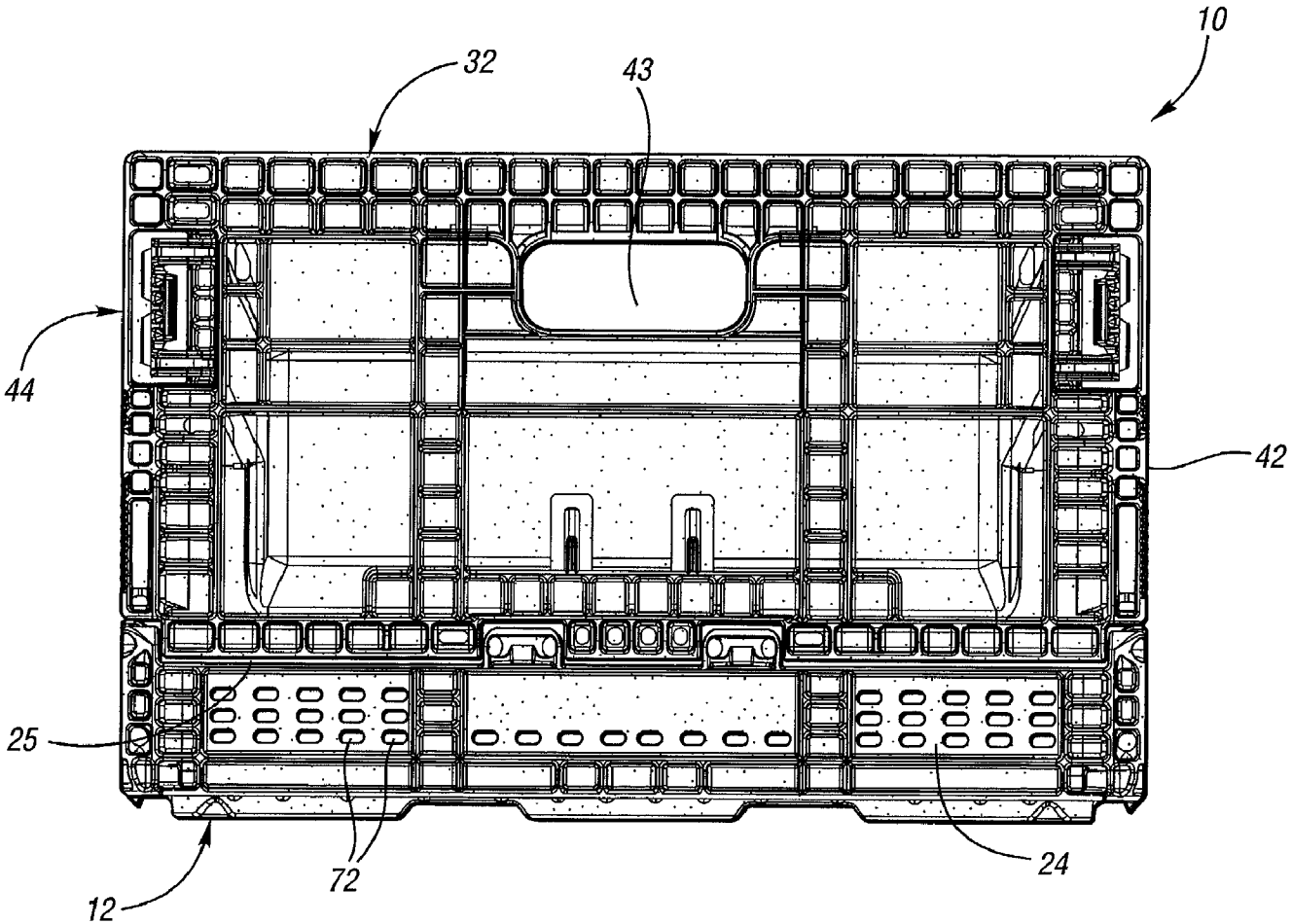
FIG. 10 illustrates an end elevational view of the container of FIG. 1, the opposite side being a mirror image thereof.

As illustrated in FIGS. 1, 3, and 10, container 10 further includes a second pair of opposed side walls 32 and 34. For ease of reference and discussion, second pair of opposed side walls is herein referred to as a pair of opposed end walls 32, 34. Like side walls 28, 30, end walls 32, 34 are similarly pivotably attached to base 12 by way of an equivalent hinging mechanism 19, 21. However, unlike the side walls, end walls 32, 34 are folded relative to base 12 at a distance remote from bottom panel 14. Particularly, end walls 32, 34 are pivotably attached to upstanding base wall flanges 24, 26, proximate upper edges 25, 27, respectively. The height of upstanding base wall flanges 24, 26 defines the aforementioned distance from which end walls 32, 34 are remote from bottom panel 14. As with the other walls discussed herein, end walls 32, 34 are partially orientable in three positions: assembled as in FIG. 1, outwardly collapsed, and inwardly collapsed.

As best shown in FIGS. 1 and 3, each end wall 32 and 34 has a U-shaped cross section formed by a main end wall portion 40, and two shorter flange portions 42 and 44 integrally attached to main end wall portion 40 and located on either side of main end wall portion 40. Flange portions 42, 44 are each oriented perpendicular to main end wall portion 40 and, in the assembled orientation of FIG. 1, are directed inward toward the opposite end wall (32 or 34). As shown in FIGS. 1–3 and 11, each side wall (28, 30) and end wall (32, 34) includes a hand opening 41 and 43, respectively, which along with the wall portion located thereabove is ideally suited to be used as a handle in order to carry container 10.

In accordance with the teachings of the present invention, container 10 further includes a locking or latching system 29 for latching side walls (28,30) together with end walls (32,34) when container 10 is oriented in the assembled orientation, as in FIG. 1, disclosed in U.S. Pat. No. 6,015,056 which is incorporated herein by reference. Of course, this type of latch system is shown by way of example and not limitation, as the latch system utilized may be any type known or contemplated which is feasible for this application. In the assembled position of FIGS. 1 and 12, container 10 is capable of being stacked with like containers 10', or in the alternative, may have other objects placed upon its assembled walls. Such like container 10' or other objects place weight and exert load on the side walls (28, 30) and end walls (32, 34) of the container. Containers 10 may be stacked upwards of ten layers high.

Figure 12:
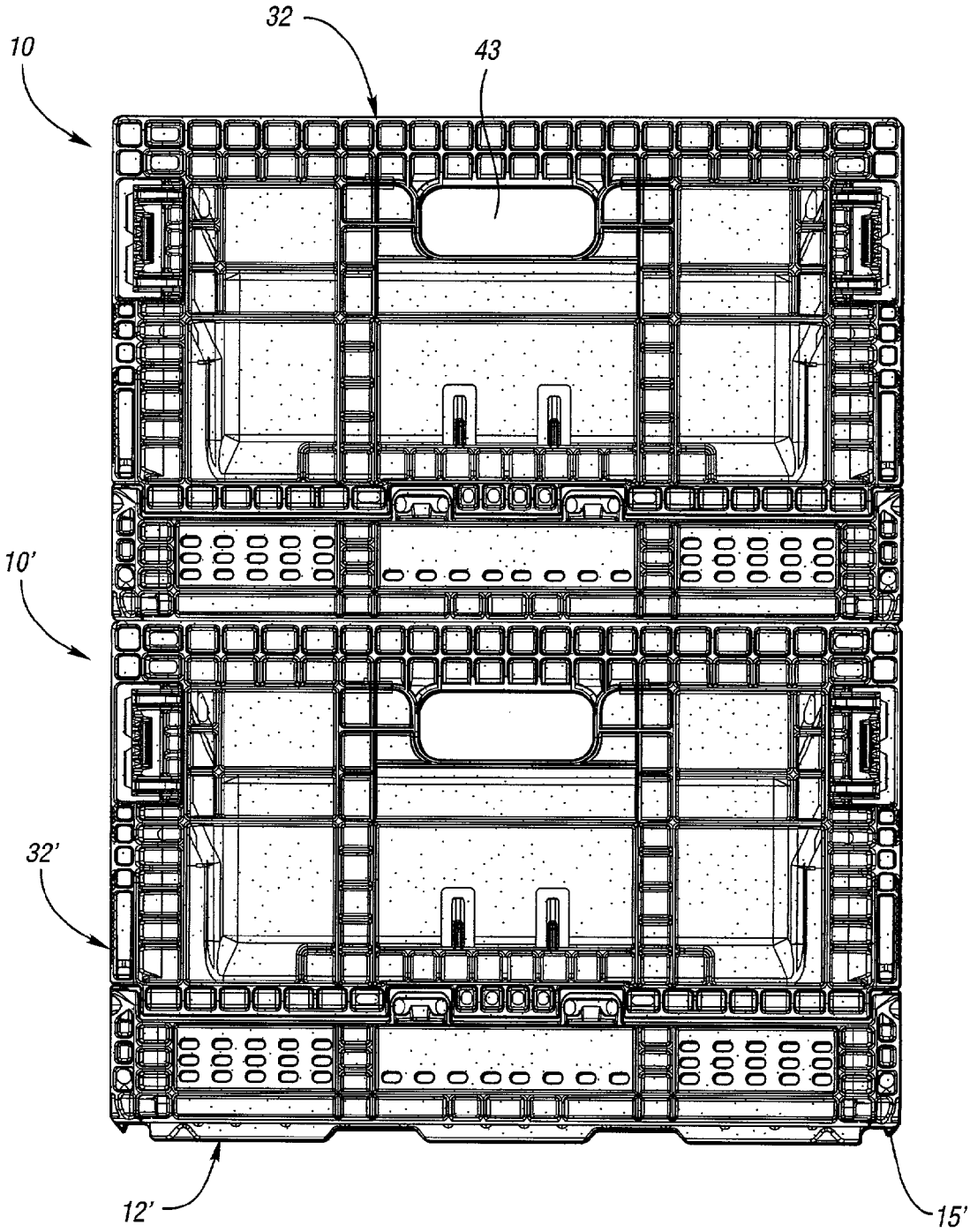
FIG. 12 is an end elevational view showing two like containers stacked upon each other.

FIG. 12 illustrates container 10 in an assembled orientation and is stacked with a like container 10' subjacent thereto. Components of container 10' are similar to those of the container 10 are correspondingly numbered, with the addition of a prime (') designation. Container 10 is stacked directly above container 10' such that each of its plurality of foot tabs 15 which extend downwardly from base 12 are aligned with and are received within corresponding upper edge recesses 17' of container 10'. Such alignment between feet 15 and recesses 17' provides additional stability and alignment to container 10 when in a stacked orientation with like container 10'.

Figure 7:
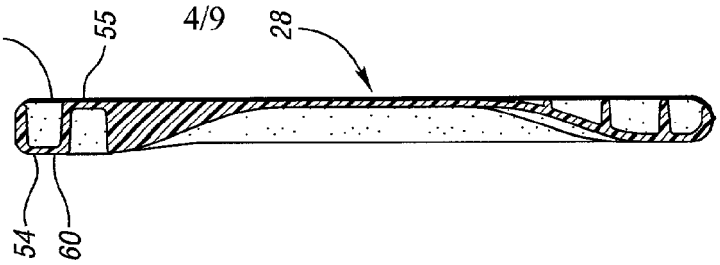
FIG. 7 is a cross-sectional view of the side wall of the container taken along line 7—7 of FIG. 4.
Figure 6:
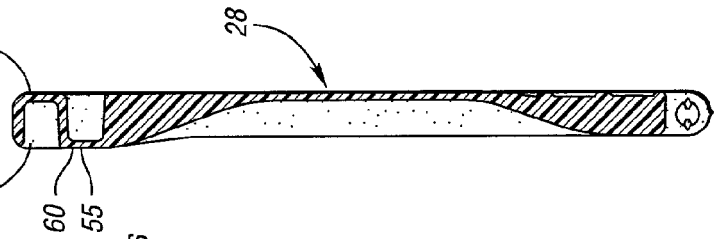
FIG. 6 is a cross-sectional view of the side wall of the container taken along the line 6—6 of FIG. 4.

In accordance with the present invention, container 10 includes an improved wall formation for counter-acting any part warpage during the molding and cooling processes, particularly as applied to the generally linear side walls. As illustrated in FIGS. 1, 3, and 4–7, each of side walls 28, 30 includes an upper edge 50, 52. Proximate upper edges 50, 52, each side wall 28, 30 includes at least one row or band portion 54 having wave-like design formed therein. The band portion 54 shown has a relatively small vertical height, compared with the height of the side wall member itself. In the embodiment illustrated, each side wall 28, 30 includes two bands 54, 55 oriented parallel and adjacent to each other proximate upper edges 50, 52. Of course, side walls may include additional bands depending on the size and properties desired from container 10. Likewise, the bands may have various heights and dimensions also dependent on the size and desired characteristics. As best illustrated in FIGS. 6–7, bands 54 and 55 are shown 180° out of phase from each other. Moreover, while the design is representatively illustrated as being integrally formed into the relatively longer side wall, these teachings are to the relatively shorter side walls 32, 24 (end wall) or the base wall 14.

Figure 5:
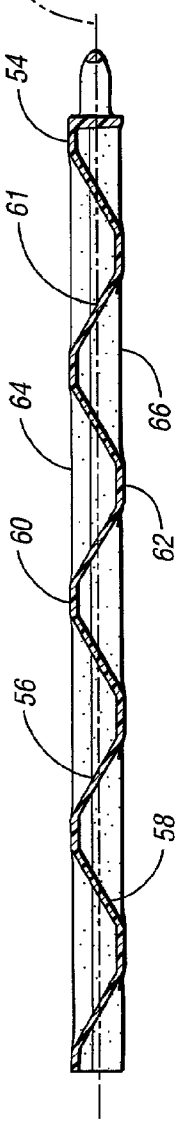
FIG. 5 is a cross-sectional view of the side wall of the container taken along the line 5—5 of FIG. 4.

The design of bands 54, 55 is best illustrated in FIGS. 4–7. FIG. 5 is a cross-sectional view taken along line 5—5 of FIG. 4 through band 54. As shown in FIG. 5, band 54 is a single-walled member and is preferably a continuous undulating wave-like member having an inner (inwardly facing) surface 56, an outer (outwardly facing) surface 58, a plurality of inwardly directed peaks 60 and outwardly directed peaks 62. Preferably, as shown in FIG. 5, band 54 may have peaks 60, 62 which are generally flat, and connected by band connect members (inclined portions 61), such as a step wave or modified square wave. Peaks 60, 62 preferably define and are generally co-planar with the inner and outer planar surfaces, 64, 66, respectively, of band members 54,55. To enhance warpage resistance, it is desirous to have as much material on the inner and outer surfaces 64,66 as possible, and that such material is also uniformly distributed away from central plane 68.

Band member 54 may also be described as an inner surface having a plurality of alternating inwardly-directed plateaus 60 and outwardly-directed recesses 63, which define a corresponding outer surface having, respectively, a plurality of alternating inwardly-directed recesses 65 and a outwardly-directed plateaus 62.

Figure 11A:
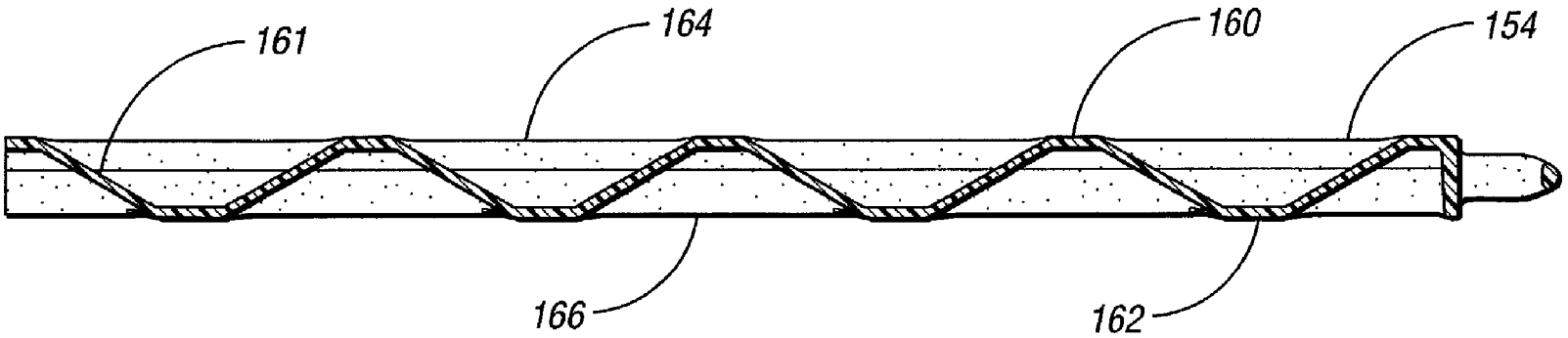
FIG. 11*a* is a view similar to that shown in FIG. 5, but where the band includes a wave-like shape, similar to a sine wave.
Figure 11B:
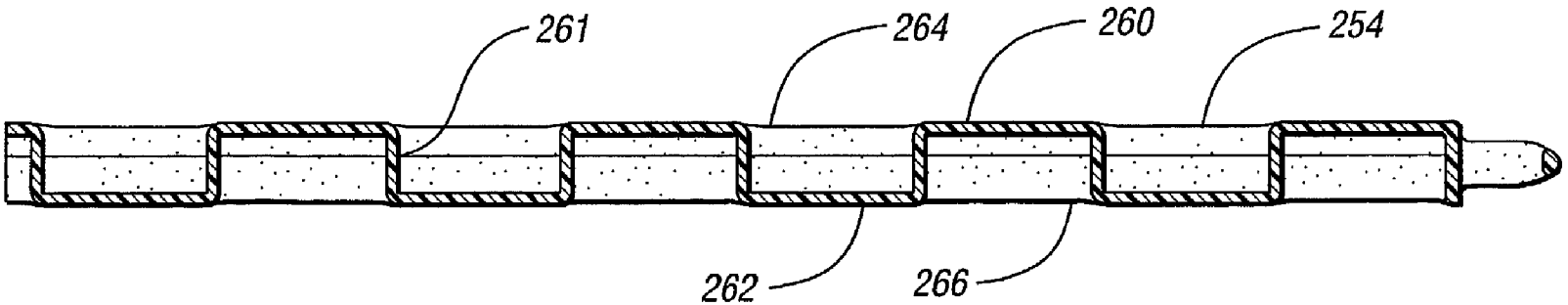
FIG. 11*b* is a view similar to that shown in FIG. 5, but where the band includes a wave-like shape, similar to a square wave.

In addition, band 54 may be designed to resemble an undulating wave-like curve with rounded peaks 160, 162, such as a sine wave curve (see FIG. 11*a*), or may even have flat peaks (plateaus) 260,262, connected by perpendicular edge members (square curves), resembling a square wave (see FIG. 11*b*). These designs also provide for uniform material distribution.

The wave-like design enhances the warping resistance of parts such as the side walls by improving the material distribution in the band area 54. By way of example, as illustrated in FIG. 5, if a plane 68 which is parallel to planar surfaces 64, 66 is oriented mid-way between surfaces 64,66, half of the material forming the band member is disposed on either side of plane 68, thus allowing for a more uniform distribution of plastic material and weight at the perimeter of side walls 28, 30, where warpage and deformation is most likely to occur, as well placing the most material away from plane 68. Thus, a wall that is 0.5 inch wide will have 0.25 inches wall material on one side of plane 68, and 0.25 inches wall material on the other side. To the contrary, prior art containers having ribs and cross-ribbing in these areas accordingly tend to have an uneven material distribution. In fact, for many containers, the ribs themselves are tapered, being thicker on the inside and smaller on the outside, thereby creating a more uneven material distribution, and thus great potential warping and bowing.

Figure 4:
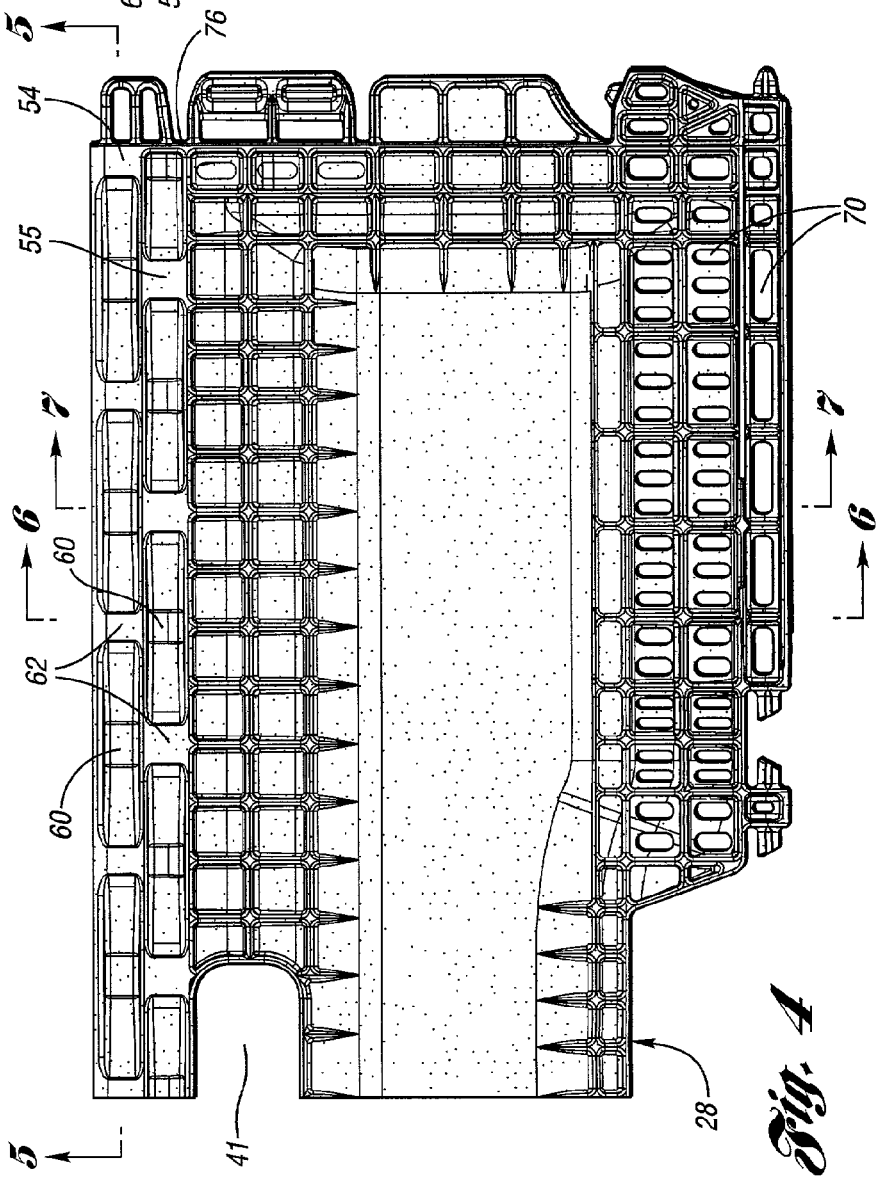
FIG. 4 is a partial side elevational view of a representative side wall of the container of FIG. 1.

FIG. 6 is a cross-sectional view taken along the line 6—6 of FIG. 4, where band 54 has an outer peak 62, and band 55 has an inner peak 60. FIG. 7 is taken along line 7—7 of FIG. 4. As illustrated therein, band 54 has a peak 60 with a flat profile directed inward, and band 55 has a peak 62 with a flat profile directed outward. This design again produces a more even material distribution between the inner and outer surfaces of the relevant component, in this case side walls 28, 30, as well as more material placed as far from the center plane 68. Of course, it is fully contemplated that a third band positioned parallel to and below band 55 would have a wave phase orientation resembling that of band 54.

Figure 2:
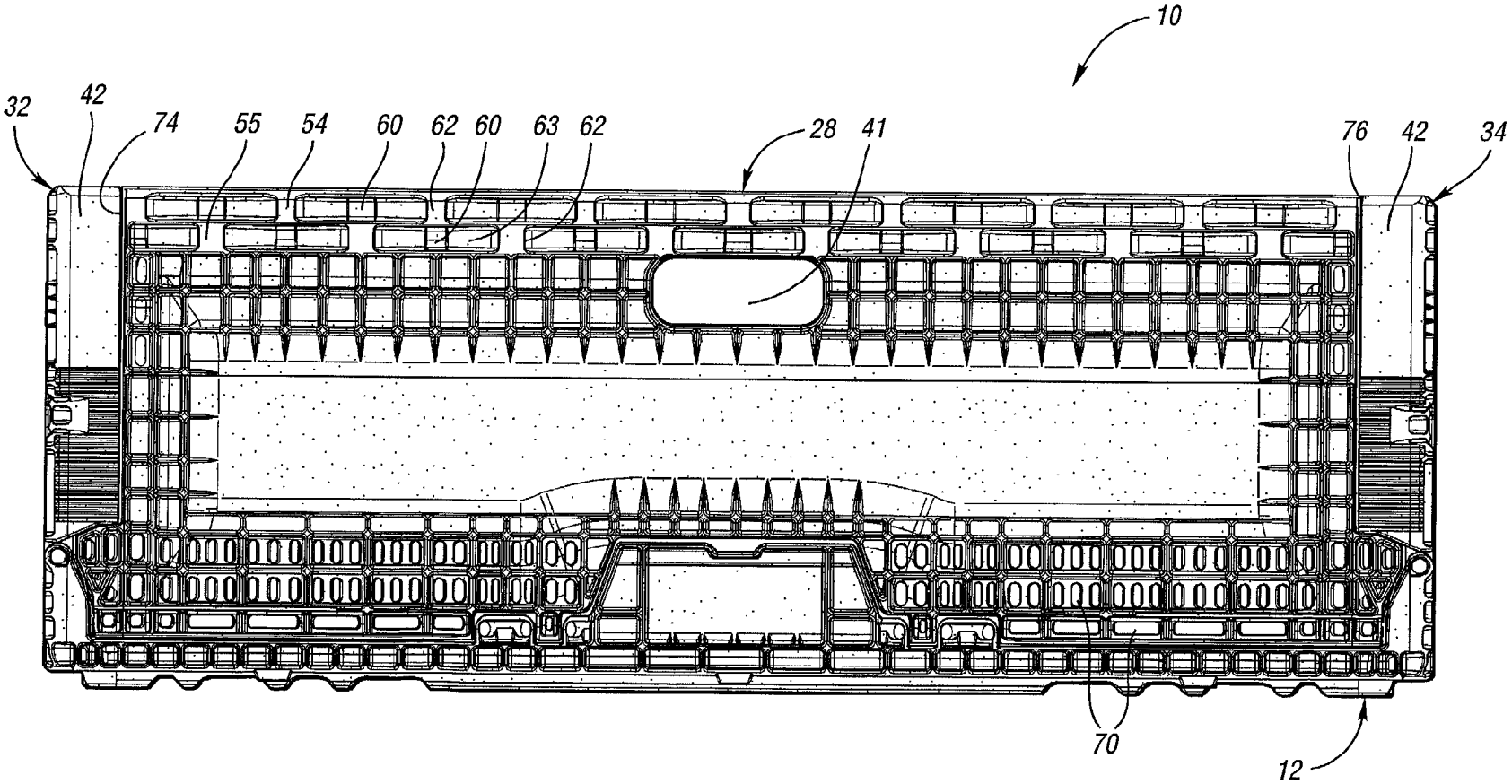
FIG. 2 illustrates a side elevational view of the container of FIG. 1, the opposite side being a mirror image thereof.
Figure 8:
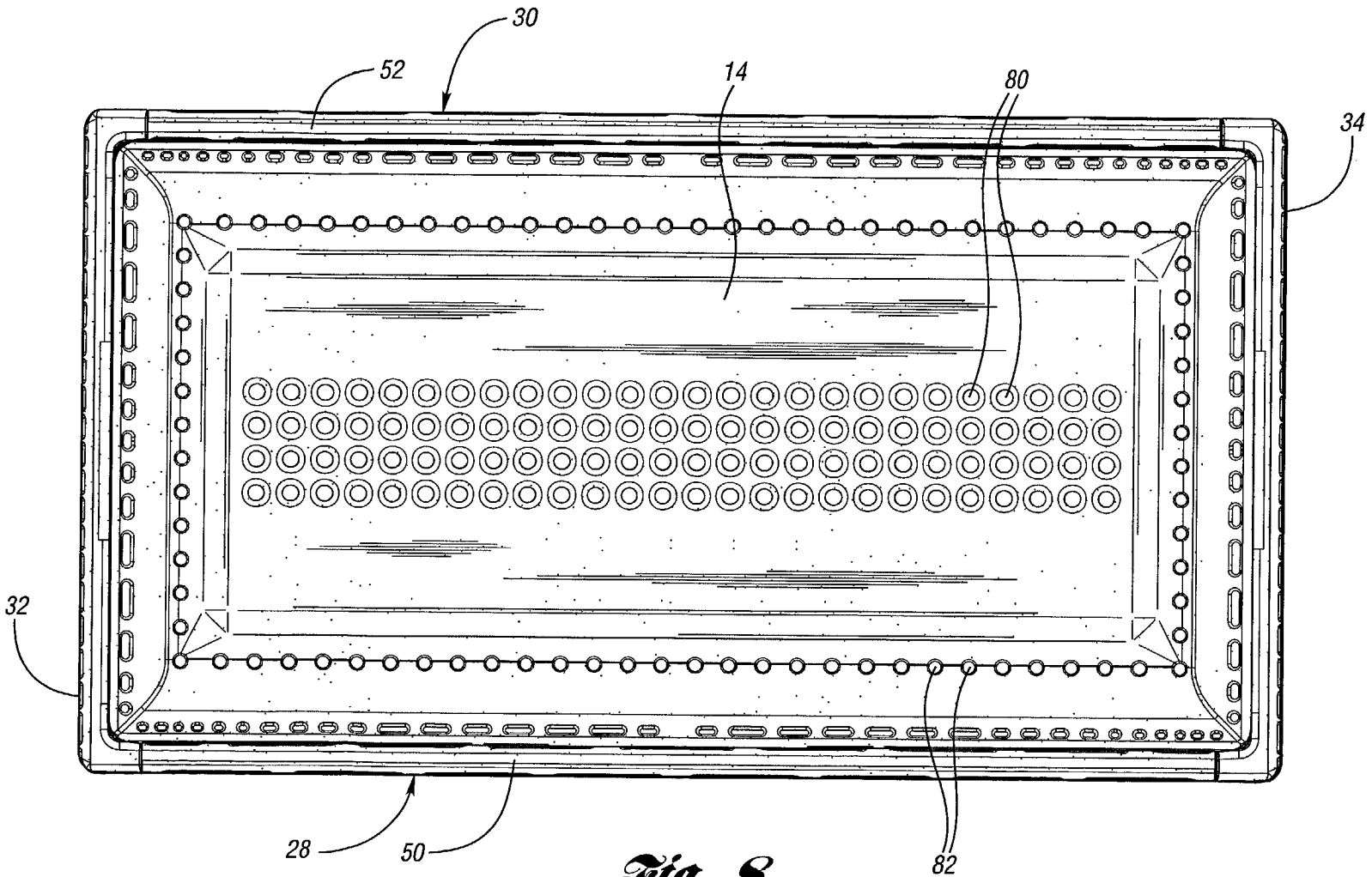
FIG. 8 illustrates a top plan view of the container of FIG. 1.

In further keeping with the teachings according to the present invention, a venting pattern for providing ventilation to the contents of container 10 is disclosed herein. More specifically, with reference to FIGS. 2, 4, 8, and 10, side walls 28, 30, end walls 32, 34 (in association with base end walls 24, 26), and bottom wall 14 each include a venting aperture system. FIG. 2 illustrates a representative side wall 28 vent pattern, while FIG. 8 illustrates a representative bottom wall 14 vent pattern, and FIG. 10 illustrates a representative end wall 32 vent pattern.

With a goal toward optimal air flow and cooling efficiencies for produce and bananas contained in container 10 and particularly for a forced air system, each of the side walls 28,30, end walls 32,34 (in combination with base end walls 24, 26), and bottom wall 14 have approximately six percent of surface area per container side dedicated to openings for venting (including handle openings 41, 43, card slots 45) for a representative container measuring 600 mm length×333 mm width×216 mm height (dimensions provided for example only, and not limitation). Also, as noted in FIGS. 2 and 10, for the side and ends of container 10, the non-handle venting apertures 70, 72 are located in a lower portion of the side proximate bottom wall 14. In this embodiment, they are disposed in a longitudinally extending portion in the lower one-fourth of the side wall between edges 74 and 76.

With regard to FIG. 10 showing the ends of the container, the venting apertures 72 are disposed in the lower one-fourth of the container end, which in the embodiment illustrated are positioned in the base wall members 24, 26. Of course, in a design where the end walls are not collapsible or are attached directly to a lower edge of base 14 (similar to side walls 28, 30), the venting apertures 72 would be formed directly within the wall itself.

Of course, the size, shape, and quantity of the venting apertures for each side also depends upon the size of handle openings 41, 43. For example, for one embodiment of container 10, handle opening 43 of end wall 32 makes up approximately 4.2% of the end surface area, thus leaving approximately 1.8% for the remaining ventilation pattern. For the long wall 28, handle opening 41 is approximately three percent of the side surface area.

Figure 9:
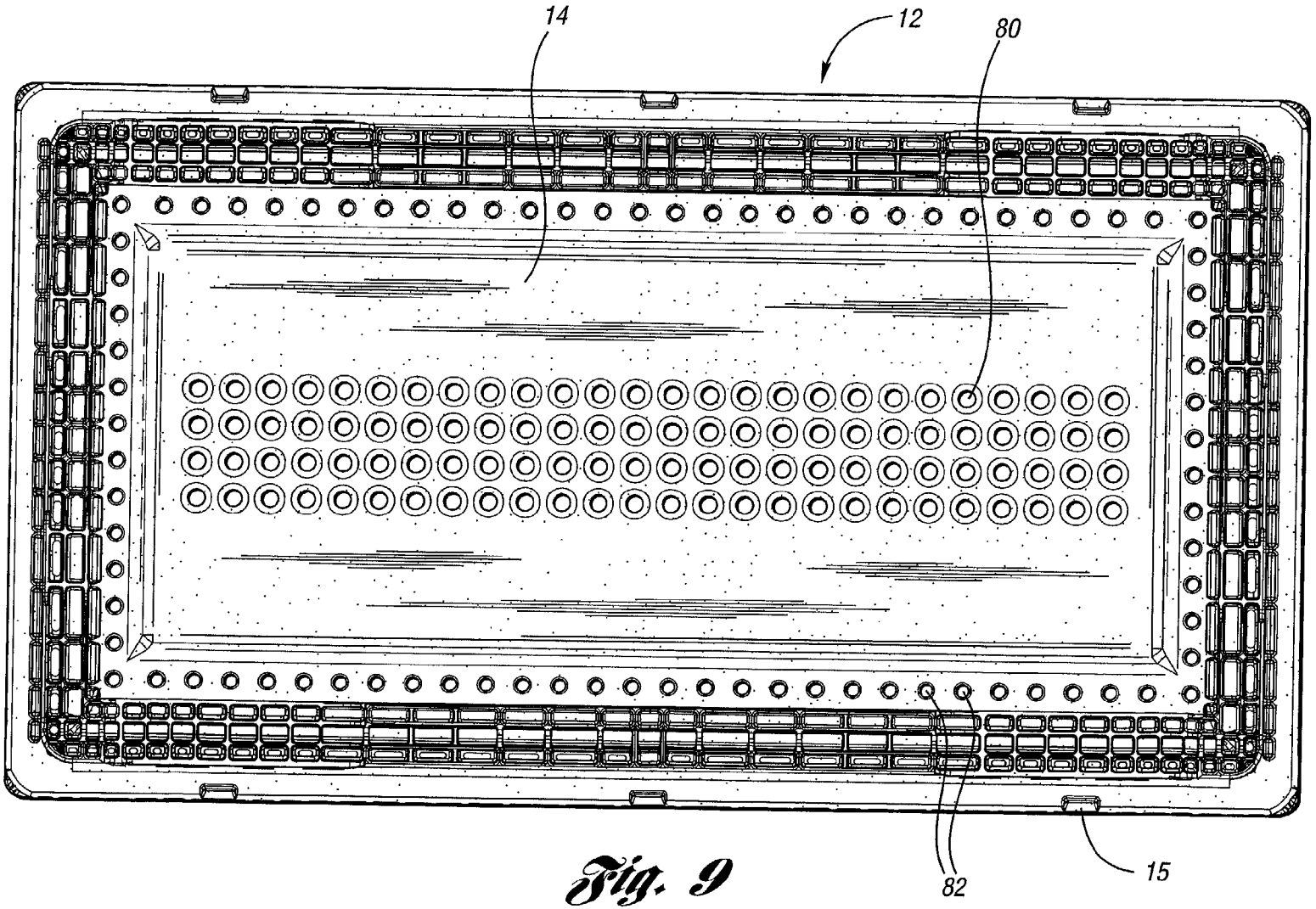
FIG. 9 is a bottom plan view of the container of FIG. 1.

With reference to FIGS. 8 and 9, base wall 14 also has approximately six percent of its surface area dedicated to ventilating apertures, wherein approximately three percent is illustrated as centrally disposed apertures 80 (having a diameter of approximately 8.0 mm) and the approximately remaining three percent of venting apertures (having a diameter of approximately 6.0 mm) are disposed about the perimeter 82 of base wall 14.

Therefore, circulation is fostered through the venting apertures disclosed herein, which also assists in efficiently controlling temperature pulldown as well as the ripening rate of the bananas or produced stored in container 10.

With respect to the venting pattern, container 10 according to the present invention is particularly well-suited for storing bananas therein. Central portions 47, 49 of side and end walls, respectively, generally serve as the locations of contact for bananas (or other goods) which are generally stored in container 10 in a "hands down" orientation, with their tips and crowns disposed downward. It is preferable for the bananas to contact a solid and continuous construction of these portions of side walls 28,30 and end walls 32,34, which therefore reduces the surface area of container 10 which is otherwise capable of submitting an opposite reactive force against the bananas (or other goods) when positioned in container 10. The bananas, accordingly, are shaped and oriented such that they do generally not contact the venting holes disposed on the lower portions of the side and end walls.

It is understood, of course, that while the forms of the invention herein shown and described include the best mode contemplated for carrying out the present invention, they are not intended to illustrate all possible forms thereof. It will also be understood that the words used are descriptive rather than limiting, and that various changes may be made without departing from the spirit or scope of the invention as claimed below.

What is claimed is:

1. A container comprising:

a base; and a plurality of walls extending from a periphery of the base, wherein at least one of the walls includes a first elongate band and a second elongate band proximate an upper edge of the at least one wall, the first and second bands each including a plurality of alternating first portions and second portions integrally-molded with the at least one wall, the first portions of the first band proximate an inner surface of the at least one wall and defining recesses in an outer surface of the at least one wall, the second portions of the first band proximate the outer surface of the at least one wall and defining recesses in the inner surface of the at least one wall, wherein the first portions and the second portions of the first band are generally equal in size and are an equal distance from the upper edge, the first portions of the second band proximate an inner surface of the at least one wall and defining recesses in the outer surface of the at least one wall, and the second portions of the second band proximate the outer surface of the at least one wall and defining recesses in the inner surface of the at least one wall, the first portions of the second band substantially aligned with the second portions of the first band, the second portions of the second band substantially aligned with the first portions of the first band.

2. The container of claim 1 wherein the at least one wall is hingeably connected to the base at a lower edge, such that the at least one wall is moveable between a collapsed position generally parallel to the base and an upright, use position generally perpendicular to the base.

3. The container of claim 1 wherein the first band extends substantially from one lateral edge of the at least one wall substantially to an opposite lateral edge of the at least one wall.

4. The container of claim 1 wherein the first band includes a plurality of transition portions each disposed between one of the first portions and one of the second portions.

5. The container of claim 4 wherein the plurality of transition portions each extend from a forward edge of one of the first or second portions to a rearward edge of another of the first or second portions.

6. The container of claim 4 wherein the plurality of transition portions are neither parallel to nor perpendicular to the first portions and wherein the plurality of transition portions are neither parallel to nor perpendicular to the second portions.

7. The container of claim 1 wherein at least a portion of each of the first portions are generally coplanar to the inner surface of the at least one wall.

8. The container of claim 7 wherein at least a portion of each of the second portions are generally coplanar to the outer surface of the at least one wall.

9. The container of claim 8 wherein the first band has a generally wave-like cross-section.

10. The container of claim 1 wherein the plurality of walls comprises a first pair of opposing walls and a second pair of walls, the second pair of walls longer than the first pair of opposing walls, and wherein the at least one wall comprises the second pair of walls.

11. The container of claim 1 wherein half of the first band is disposed between each of the inner and outer surfaces of the at least one wall and a plane oriented parallel to and mid-way between the inner and outer surfaces of the at least one wall.

12. A collapsible container comprising:

a base; and a plurality of walls each hingeably connected to the base at a lower edge and moveable between a collapsed position substantially parallel to the base and an upright, use position substantially perpendicular to the base, wherein at least two of the walls each includes a first band portion extending laterally across the wall proximate an upper edge of the walt the first band portion including alternating inwardly-directed peaks and outwardly-directed recesses on an inner surface of the at least two walls forming alternating inwardly-directed recesses and outwardly-directed peaks on an outer surface of the at least two walls respectively, the at least two of the walls each further including a second band portion having peaks and recesses out of phase with the peaks and recesses of the first band portion, the second band portion spaced farther from the upper edge than the first band portion.

13. The collapsible container of claim 12 wherein the peaks have a generally rounded profile.

14. The collapsible container of claim 12 wherein the peaks have a generally flat profile.

15. The collapsible container of claim 12 wherein the inwardly-directed peaks extend to a plane defined by the inner surface of the wall.

16. The collapsible container of claim 15 wherein the outwardly-directed peaks extend to a plane defined by the outer surface of the wall.

17. A collapsible container comprising:

a base; and a plurality of walls extending upwardly from a periphery of the base, wherein at least one of the walls includes at least one elongate band proximate an upper edge of the at least one wall and extending longitudinally substantially from a lateral edge of the at least one wall substantially to an opposite lateral edge of the at least one wall, the at least one band including a plurality of longitudinally alternating single-wall first portions and single-wall second portions integrally-molded with the at least one wall, the first portions having a longitudinal length equal to that of the second portions, at least a portion of each of the first portions substantially reaching a plane defined by an inner surface of the at least one wall and at least a portion of each of the second portions substantially reaching a plane defined by an outer surface of the at least one wall.

18. The collapsible container of claim 17 wherein the at least one band includes a plurality of transition portions each disposed between one of the first portions and one of the second portions.

19. The container of claim 18 wherein the plurality of transition portions each extend from a forward edge of one of the first or second portions to a rearward edge of another of the first or second portions.

20. The container of claim 18 wherein the plurality of transition portions are neither parallel to nor perpendicular to the first portions and wherein the plurality of transition portions are neither parallel to nor perpendicular to the second portions.

21. The container of claim 17 wherein the plurality of walls are hingeably connected to the base at a lower edge, such that the walls are moveable between a collapsed position generally parallel to the base and an upright, use position generally perpendicular to the base.

* * * * *

UNITED STATES PATENT AND TRADEMARK OFFICE

CERTIFICATE OF CORRECTION

PATENT NO. : 7,086,555 B2
APPLICATION NO. : 10/164038
DATED : August 8, 2006
INVENTOR(S) : Overholt et al.

It is certified that error appears in the above-identified patent and that said Letters Patent is hereby corrected as shown below:

In Claim 12, Column 9, Line 3, “walt” should read as --wall--.

Signed and Sealed this

Twenty-first Day of November, 2006

JON W. DUDAS
*Director of the United States Patent and Trademark Office*